US005622113A

United States Patent [19]

Hansen

[11] Patent Number: 5,622,113

[45] Date of Patent: Apr. 22, 1997

[54] GRIPPING SURFACE FOR CUTTING CYLINDERS IN A FOLDING MACHINE

[75] Inventor: Robert E. Hansen, Clarendon Hills, Ill.

[73] Assignee: Goss Graphic Systems, Inc., Westmont, Ill.

[21] Appl. No.: 535,503

[22] Filed: Sep. 28, 1995

[51] Int. Cl.[6] ..... B41F 1/28

[52] U.S. Cl. ..... 101/483; 101/415.1; 493/370; 493/454; 493/324

[58] Field of Search ..... 101/415.1, 409, 101/410, 375, 378, 232, 483; 493/324, 370, 454

[56] References Cited

U.S. PATENT DOCUMENTS

| | | | |
|---|---|---|---|
| 2,014,095 | 9/1935 | Wood | 101/378 |
| 2,189,682 | 2/1940 | Schmutz | 101/415.1 |
| 2,820,409 | 1/1958 | Johnson | 101/415.1 |
| 3,295,443 | 1/1967 | Devon | 101/415.1 |
| 4,973,040 | 11/1990 | Kemp et al. | 101/232 |
| 5,029,842 | 7/1991 | Belanger et al. | 271/188 |

FOREIGN PATENT DOCUMENTS

| | | | |
|---|---|---|---|
| 0279947 | 8/1988 | European Pat. Off. | 101/415.1 |
| 1383859 | 11/1964 | France | 101/415.1 |
| 2914752 | 10/1979 | Germany | 101/415.1 |

*Primary Examiner*—Eugene H. Eickholt
*Attorney, Agent, or Firm*—Marshall, O'Toole, Gerstein, Murray & Borun

[57] ABSTRACT

A gripping surface adapted to be mounted on the outer circumferential surfaces of a pair of cutting cylinders 12, 14 in a printing press is provided. The gripping surface includes a plurality of mounting strips 26. Each mounting strip 26 has an upper surface and a lower surface and a layer of VELCRO™ brand gripping material 38 mounted on the upper surface. The layer of gripping material 38 is mounted on the upper surface of each mounting strip 26 using a self adhesive. At least one keeper tab 36 is disposed on the lower surface of each mounting strip 26. The keeper tab 36 is mounted in a "t" slot formed on the outer circumferential surface of the cylinder on which the mounting strip is mounted. The mounting strips 26 are flat and formed of a thermoplastic material using an injection molding process.

22 Claims, 3 Drawing Sheets

22
26
10
38
30
34
24
36
25
38
26
26
38
14
25
24
34
36
30
16
22
18
32
28
36
23
21
20
38
26
38
26
12
20
21
23
36
28
32
26
38
18

GRIPPING SURFACE FOR CUTTING CYLINDERS IN A FOLDING MACHINE

FIELD OF THE INVENTION

This invention relates generally to offset printing presses and more particularly to the gripping surface of a cutting cylinder used in cutting webs of paper in the folding section of an offset printing press.

BACKGROUND OF THE INVENTION

Typical offset lithographic printing presses comprise five basic components: a web feed, a printing unit or units, a dryer, a chill roll unit and a folder. The printing press has one or more printing units depending upon the number of colors which are needed for the particular printing task. A printing unit is needed for each color. A typical newspaper press only has one printing unit for the color black. A full color printing press may have either four or five printing units depending upon whether or not a special color is used. The three primary printing colors are yellow, cyan and magenta.

The web feed feeds a web, i.e., one continuous sheet, of paper through the priming units. A web is usually between 38.0 inches and 54.0 inches wide. Typically, up to six pages may be printed across the width of the web. After the web exists the printing unit(s), it passes through a dryer. Water is used in applying the ink to the paper. Consequently, the paper is wet exiting the printing units. The dryer is used to dry the ink onto the paper so that it does not smear.

After the web exists the dryer, it passes through the chill roll unit which comprises a plurality of chill rollers which cool down the web before it passes through the folding section of the printing press. The folding section of the printing press, or folder as it is also known, is a separate stand-alone unit which connects to the end of the chill roll unit which in turn connects to the end of the dryer. The dryer in turn connects to the priming units. The folder folds and cuts the web of paper into signatures, which are booklets containing a plurality of pages for subsequent insertion into other signatures as in a newspaper or binding as in a magazine or book.

Before the web is cut laterally, it is folded longitudinally by a device known as a former board, which is a triangular board over which the web is draped. A pair of forming rollers are also provided which cooperate with the former board to form the primary longitudinal fold. Prior to being folded lengthwise, the web may also be cut across its width into a plurality of strips known as ribbons. Once folded lengthwise, each ribbon passes through an associated pair of cutting cylinders which cuts the ribbon laterally. One of the pair of cylinders has at least one knife, and the other has an at least one associated anvil, which cooperates with the knife to form the cut in the associated ribbon.

In known devices, two layers of VELCRO™ brand gripping material are placed on the outer circumferential surfaces of the cutting cylinders. The VELCRO™ brand gripping material surfaces are provided for corrugating the folded ribbons and imparting a certain stiffness to the ribbons so that they exit the cutting cylinders in a straight configuration. This facilitates the transfer of the ribbons into the high speed section of the folder.

Each layer of VELCRO™ brand gripping material is typically formed by placing a plurality of 0.75 inch wide velcro strips spaced 1.50 inches apart around virtually the entire circumference of the cylinders. Approximately 50 strips of VELCRO™ brand gripping material are used in each layer. The VELCRO™ brand gripping material is attached to the cylinder with an adhesive. The longitudinally folded web passes through the cutting cylinders at a high speed, up to 3,000 feet per minute. Over time, the friction between the web and the VELCRO™ brand gripping material surface of the cutting cylinders causes the VELCRO™ brand gripping material to wear out. In fact, one or more VELCRO™ brand gripping material strips must be replaced on a somewhat regular basis.

Replacing the VELCRO™ brand gripping material strips is a time consuming task. It requires peeling off the worn VELCRO™ brand gripping material strips, scraping residue adhesive, cleaning the cylinder with solvents, properly aligning the new VELCRO™ brand gripping material strips on the cylinder and then mounting them to the surface of the cylinders. This can take anywhere between one-half an hour to three hours depending on the amount of VELCRO™ brand gripping material strips that needs to be replaced. Also, additional time is required to allow the strips to cure. Because the folder is in-line with the printing units, when the folder is shut down for servicing, the entire printing press must be shut down. Accordingly, the time spent in replacing the VELCRO™ brand gripping material strips is lost printing time. Such "down time" can be very costly for the printer.

The present invention is directed to overcoming or at least minimizing some of the problems mentioned above.

SUMMARY OF THE INVENTION

In accordance with one aspect of the present invention, a gripping surface adapted to be mounted on the outer circumferential surfaces of a pair of cutting cylinders in a printing press is provided. The gripping surface includes a plurality of plastic mounting strips. Each mounting strip has an upper surface and a lower surface. A layer of VELCRO™ brand gripping material is mounted on the upper surface of each of the mounting strips. The VELCRO™ brand gripping material is mounted on the upper surface of each mounting strip using an adhesive which may be a self adhesive or applied separately. At least one keeper tab is disposed on the lower surface of each mounting strip. The keeper tab is mounted in a "t" slot formed in the outer circumferential surface of each cylinder on which a mounting strip is mounted.

In another aspect of the present invention, a method of mounting a gripping surface on the outer circumferential surface of a cylinder in a printing press is provided. The method includes the step of inserting one end of a mounting strip having a layer of gripping material disposed on its upper surface into a slot formed on the outer circumferential surface of the cylinder. The method also includes the step of inserting at least one keeper tab mounted on the mounting strip into a corresponding at least one "t" slot formed on the outer circumferential surface of the cylinder. The method further includes the step of repeating the inserting steps for a plurality of mounting strips, the plurality of mounting strips being mounted along the outer circumferential surface of the cylinder. The method further includes the step of removing worn mounting strips before new mounting strips are mounted. In the preferred method, the layer of gripping material is mounted on the mounting strips using a self adhesive before the mounting strips are mounted on the cylinder.

BRIEF DESCRIPTION OF THE DRAWINGS

Other aspects and advantages of the present invention will become apparent upon reading the following detailed description and upon reference to the drawings in which.

DETAILED DESCRIPTION OF THE PREFERRED EMBODIMENTS

Figure 1:
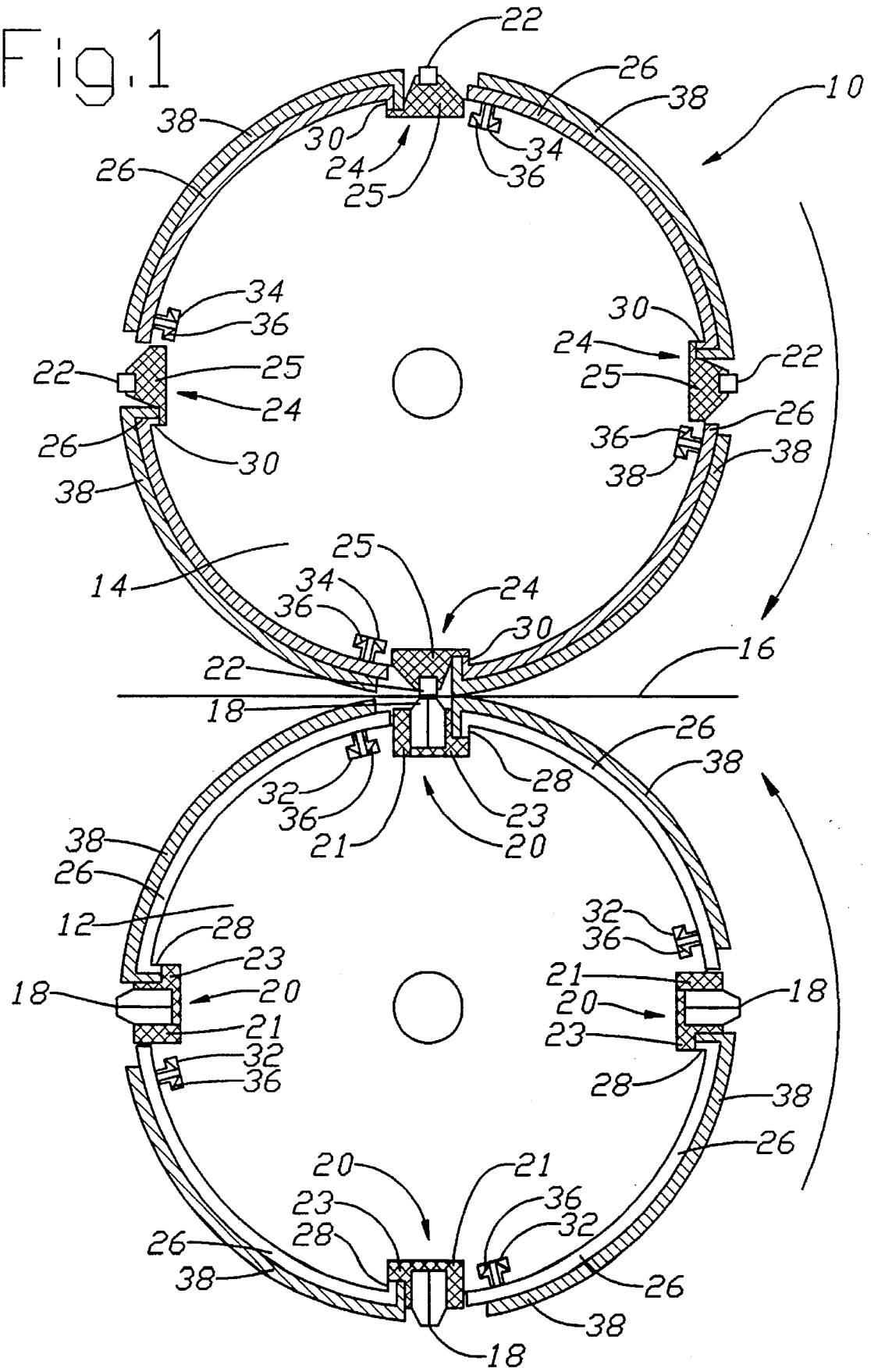
FIG. 1 is a schematic diagram of one embodiment of a pair of cutting cylinders in a folder illustrating a gripping surface according to the present invention.

Turning now to the drawings and referring initially to FIG. 1, a cutting section 10 of a folder is illustrated. The cutting section 10 includes a pair of cylinders 12 and 14 which cooperate to cut a web of paper 16 laterally which enters the cutting section 10 of the folder after having been folded longitudinally over a former board (not shown).

Figure 2:
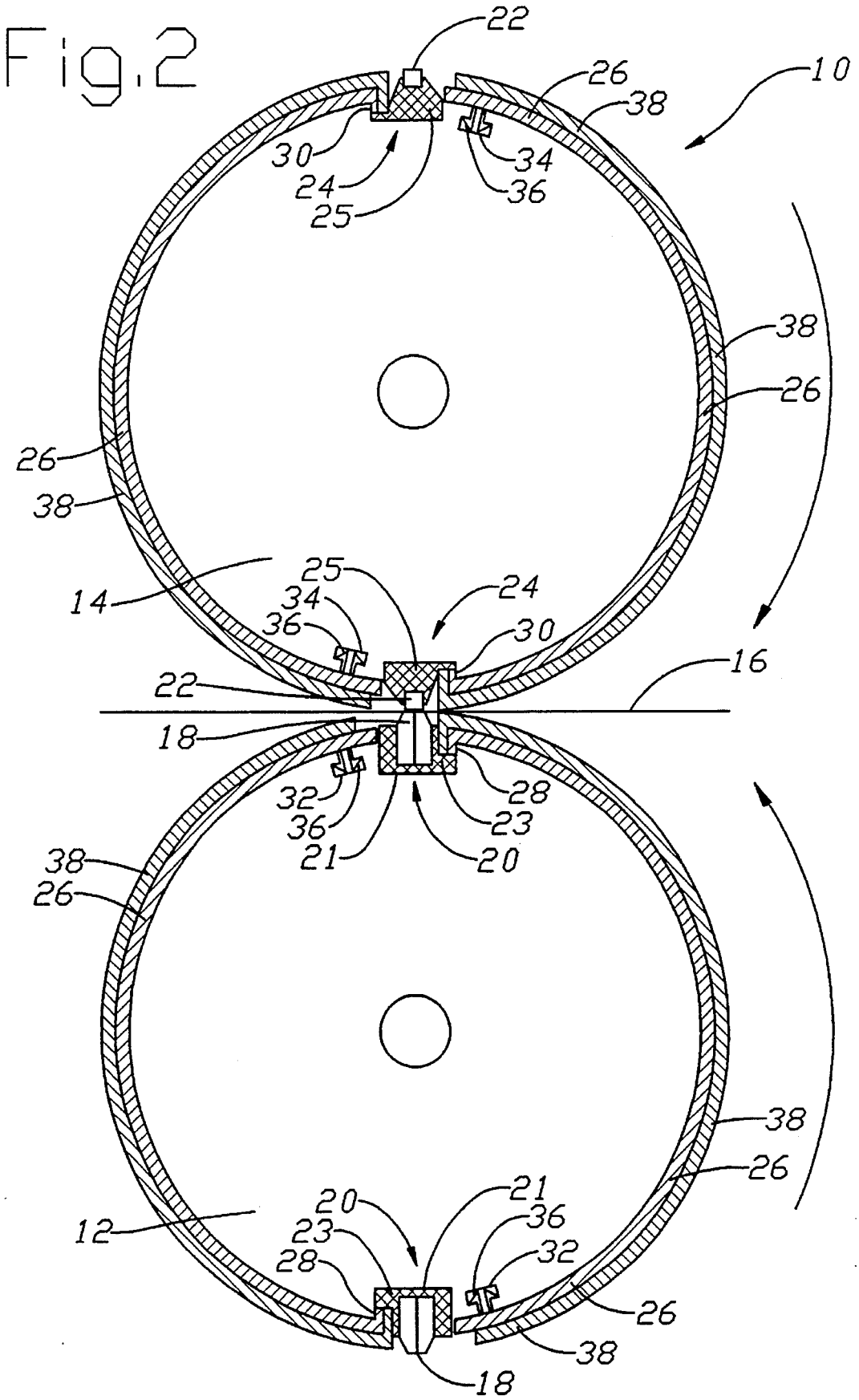
FIG. 2 is a schematic diagram of another embodiment of a pair of cutting cylinders in a folder illustrating the gripping surface according to the present invention.

The cylinder 12 has a plurality of knives 18 disposed on its outer circumferential surface. Each knife 18 is mounted within a knife box 20. Each knife box 20 is defined by a pair of interconnecting mounting bars 21 and 23 disposed in a groove formed in the outer circumferential surface of the cylinder 12. The mounting bar 21 is substantially straight and the mounting bar 23 is substantially "L" shaped. The mounting bars 21 and 23 are preferably formed of steel. In one embodiment, there are four (4) knives disposed on the outer circumferential surface of the cylinder 12, each knife being disposed at 90° from an adjacent knife, as shown in FIG. 1. In another embodiment, there are two (2) knives disposed on the surface of the cylinder 12, each knife being disposed 180° from the other, as shown in FIG. 2. In FIG. 1, there are four cutting sectors, each cutting sector being defined by a knife/anvil 18/22 pair, and in FIG. 2, there are two cutting sectors. As a person of ordinary skill in the art will appreciate any number of knife/anvil pairs 18/22 may be provided depending upon the length of the desired signatures to be formed.

The cylinder 14 has a plurality of anvils 22 disposed on its outer circumferential surface. Each anvil 22 is mounted within an anvil box 24 and is preferably formed of a rubber material. Each anvil box 24 is defined by a mounting bar 25 disposed in a groove formed in the outer circumferential surface of the cylinder 14. The mounting bar 25 is preferably formed of steel. In the embodiment shown in FIG. 1, there are four (4) anvils 22 disposed on the outer circumferential surface of the cylinder 14, each anvil being disposed at 90° from an adjacent anvil. In the embodiment shown in FIG. 2, there are two (2) anvils 22 disposed on the outer circumferential surface of the cylinder 14, each anvil being disposed 180° from the other. The knives 18 and the anvils 22 cooperate with one another to cut the web or ribbon of paper 16 laterally. The embodiment shown in FIG. 2 may be achieved with the device shown in FIG. 1, simply by inactivating alternate knife/anvil 18/22 pairs. Since the knife/anvil 18/22 pair is well known in the art and does not form a part of the present invention, it will not be discussed in further detail.

A plurality of mounting strips 26 are mounted on the outer circumferential surfaces of the cylinders 12 and 14, as shown in FIGS. 1 and 2. Each mounting strip 26 is a flat rail having one end which is bent at a 90° angle and formed of a thermoplastic material, e.g., polypropylene. The mounting strip 26 is preferably formed by an injection molding process. Furthermore, each mounting strip 26 is approximately 0.625 inches wide, 0.090 inches thick and between 9.0 and 13.5 inches long, depending on the length of the signatures.

The plastic mounting strips 26 are mounted at one end in slots 28 and 30 disposed adjacent to the knife and anvil boxes 20 and 24, respectively. The slots 28 and 30 are formed in the mounting bars 23 and 25, respectively. The slots 28 and 30 enable the mounting strips 26 to be spaced apart more accurately and straighter, and thus help create more even signatures. The plastic mounting strips 26 are mounted at the other end in "t" slots 32 and 34, which are channel shaped slots formed in the outer circumferential surfaces of the cylinders 12 and 14, respectively. Each mounting strip 26 is provided with a keeper tab 36 defined by a pair of projecting members each having flanged tips. The keeper tabs 36 are mounted on the lower surface of the mounting strips 26 at the end opposite the bent end. The keeper tabs 36 snap into the "t" slots 32 and 34.

In the embodiment shown in FIG. 1, the "t" slots 32 and 34 are disposed on the outer circumferential surfaces of the cylinders 12 and 14 approximately 66° from 90° bend near knives 18 and anvils 22, respectively. In the embodiment shown in FIG. 2, the "t" slots 32 and 34 are disposed on the outer circumferential surfaces of the cylinders 12 and 14 approximately 146° from the 90° bend near knives 18 and anvils 22, respectively.

Figure 3:
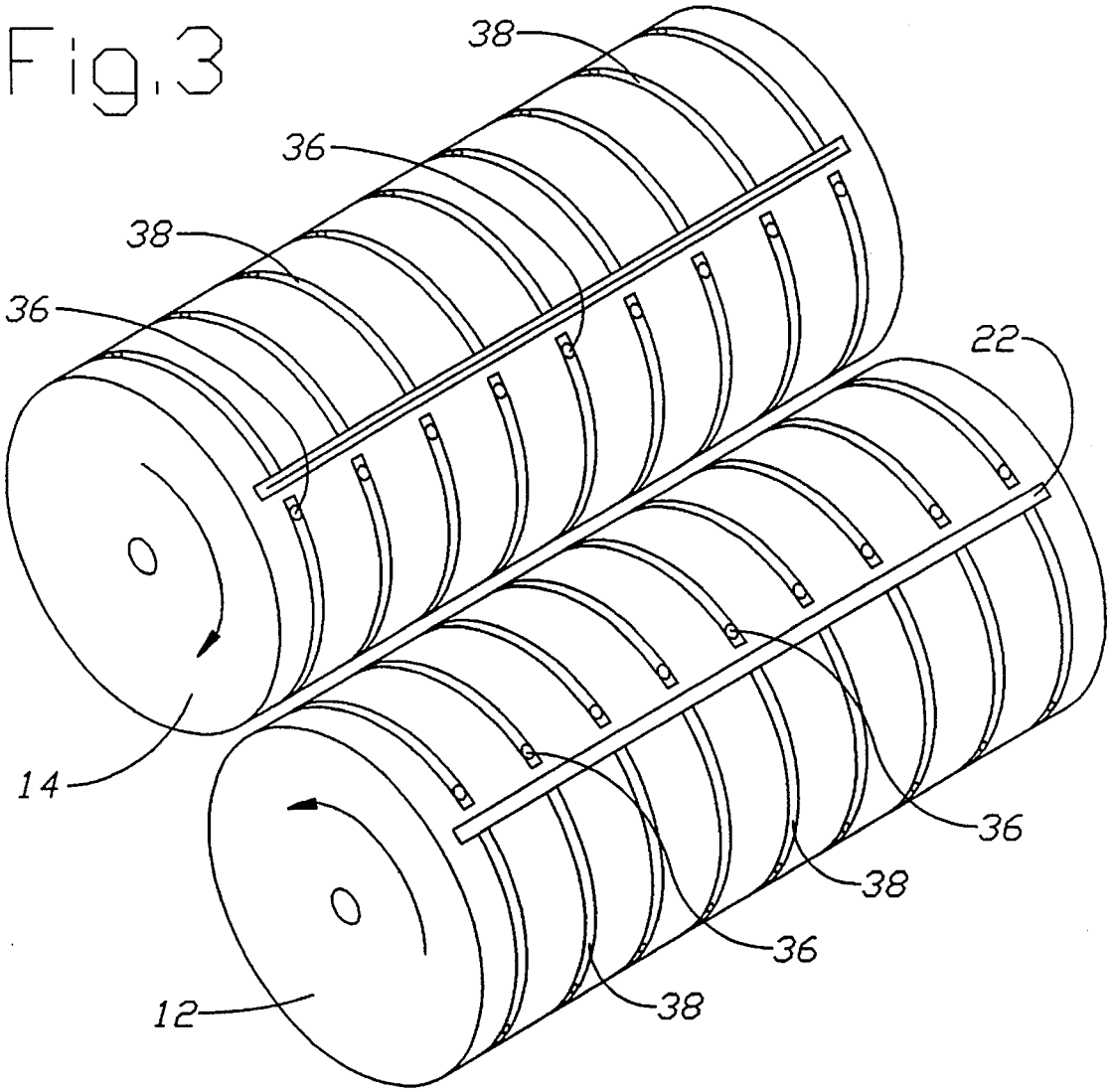
FIG. 3 is a perspective view of a pair of cutting cylinders in a folder illustrating the gripping surface according to the present invention.

Each of the cylinders 12 and 14 preferably has sixteen (16) mounting strips 26 mounted along its length in each cutting sector. The number of mounting strips 26 shown in FIG. 3 is illustrative only. The mounting strips 26 are preferably mounted 0.75 inches apart from one another. The mounting strips 26 are alternately spaced on the surfaces of the cylinders 12 and 14, i.e., mounting strips are disposed on the surface of one cylinder so as to engage with spaces on the other cylinder as the cylinders are rotated and not with other mounting strips, as shown in FIG. 3.

A layer of gripping material 38, preferably VELCRO™ brand gripping material, is mounted on the upper surface of each mounting strip 26, as shown in FIGS. 1 and 2. Each layer of gripping material 38 is approximately 0.625 inches wide, 0.20 inches thick and between 9.0 and 13.5 inches long, depending on the length of the signature. The layers of gripping material 38 are attached to the surfaces of the mounting strips 26 with an adhesive material, e.g., olefin pressure sensitive adhesive.

Figure 4:
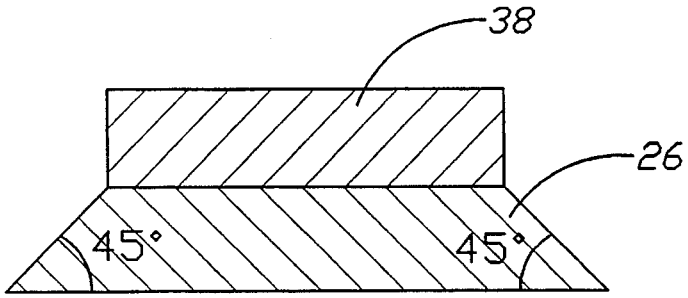
FIG. 4 is a cross-sectional view of a layer of VELCRO™ brand gripping material mounted on a mounting strip forming the gripping surface according to the present invention.

FIG. 4 shows a cross-sectional view of the layer of gripping material 38 mounted on the surface of the mounting strip 26. As shown in FIG. 4, the upper surface of the mounting strip 26, on which the layer of gripping material 38 is mounted, is narrower than its lower surface, which is mounted on the cutting cylinders 12 and 14. The width of the lower surface is 0.75 inches and the width of the upper surface is 0.625 inches, which corresponds to the width of the layer of gripping material 38. A chamfer is formed between the upper surface and the lower surface of the mounting strip 26 which is preferably 45°.

The layers of gripping material 38 may be mounted on the mounting strips 26 either before or after the mounting strips are mounted on the cylinders 12 and 14. Preferably, however, they are mounted on the mounting strips 26 before the mounting strips 26 are mounted on the cylinders 12 and 14, so that this step need not be performed while the printing press is shut down. This enables worn gripping surfaces to be replaced very quickly.

In fact, the gripping surfaces according to the present invention, can be replaced in as little as 15 seconds. Each mounting strip 26 is mounted as follows. First, the mounting member 26 is prepared for mounting. This preparation step includes forming the mounting strip 26 using an injection molding process. During this step, a bend in one end of the mounting strip 26 is formed. Next, a layer of VELCRO™ brand gripping material 38 is mounted on the upper side of the mounting strip 26 using a self adhesive. Once the mounting strip 26 has been prepared for mounting, the old gripping surface can be removed. This is accomplished by stopping the printing press and allowing the cutting cylinders to come to rest. Once this has occurred, the worn mounting strip 26 can be removed. The worn mounting strip 26 is removed from the surface of the cylinder 12 or 14. As the worn mounting strip 26 is removed from the surface of the cylinder 12 or 14, the keeper tabs 36 may crack or become broken.

Next, the new mounting strip 26, which has been pre-mounted with the VELCRO™ brand gripping material layer 38, is mounted at its bent end in the appropriate box slot and mounted at the other in the appropriate "t" slot. The keeper tab 36 is snapped into the "t" slot using a rubber mallet or a press operator's thumb and wrist.

This method may then be repeated for each mounting strip 26 which needs to be replaced. Of course, all those mounting strips 26 needing replacement would be preferably replaced at the same time while the printing press is shut down. As suggested above, an alternative method of mounting the gripping surfaces may be to first mount the mounting strips 26 and then mount the layer of gripping material 38. The drawback of this method is that the printing press is shut down during this step, thus adding unnecessary "down time." As those of ordinary skill in the art will recognize, the first method described herein is the preferred method.

Those skilled in the art who now have the benefit of the present disclosure will appreciate that the present invention may take many forms and embodiments. Some embodiments have been described so as to give an understanding of the invention. It is intended that these embodiments should be illustrative, and not limiting of the present invention. Rather, it is intended that the invention cover all modifications, equivalents and alternatives falling within the spirit and scope of the invention as defined by the appended claims. For example, although the gripping surface according to the present invention has been described as being adapted for mounting on the surface of cutting cylinders in the folding section of a printing press, it may also be adapted for use on other cylinder pairs in the folder as well as in other components of the printing press.

What is claimed is:

1. A gripping surface adapted to be mounted on the outer circumferential surface of a cutting cylinder in a printing press, comprising:

at least one mounting strip having an upper surface and a lower surface, and a layer of gripping material mounted on the upper surface of the at least one mounting strip that corrugates ribbons passing through the folding section of the printing press and imparts a certain stiffness to the ribbons so that they exit the cutting cylinder in a straight configuration.

2. The gripping surface according to claim 1, further comprising a keeper tab disposed on the lower surface of the mounting strip.

3. The gripping surface according to claim 2, wherein the at least one keeper tab is mounted in a "t" slot formed on the outer circumferential surface of the cylinder.

4. The gripping surface according to claim 1, wherein the at least one mounting strip is formed of a thermoplastic material using an injection molding process.

5. The gripping surface according to claim 1, wherein the layer of gripping material is formed of VELCRO™ brand gripping material.

6. The gripping surface according to claim 5, wherein the VELCRO™ brand gripping material is mounted on the upper surface of the at least one mounting strip using a self adhesive.

7. The gripping surface according to claim 1, wherein a plurality of mounting strips are mounted along the outer circumferential surface of the cylinder.

8. The gripping surface according to claim 7, wherein four rows of sixteen mounting strips are mounted along the outer circumferential surface of the cylinder.

9. The gripping surface according to claim 1, wherein the upper surface of the at least one mounting strip is narrower than the lower surface, and a 45° chamfer is formed between the upper surface and the lower surface.

10. A folder for use in a printing press, comprising:

a pair of cutting cylinders cooperating with one another to cut a web of paper being transported between said cutting cylinders;

a plurality of mounting strips, each mounting strip having an upper surface and a lower surface, said plurality of mounting member strips being mounted on at least one of the pair of cutting cylinders; and a layer of gripping material mounted on the upper surface of each of the mounting strips.

11. The folder according to claim 10, wherein the plurality of mounting strips are mounted on each of the pair of cutting cylinders.

12. The folder according to claim 11, wherein the plurality of mounting strips are mounted along the length of each of the pair of cutting cylinders in an alternating pattern so that the mounting strips on opposite cylinders do not engage one another.

13. The folder according to claim 12, wherein four rows of sixteen mounting strips are mounted along the outer circumferential surface of each of the pair of cutting cylinders.

14. The folder according to claim 10, wherein each mounting strip has at least one keeper tab disposed on its lower surface for mounting in a "t" slot formed on the outer circumferential surface of the at least one of the pair of cutting cylinders.

15. The folder according to claim 10, wherein the upper surface of each mounting strip is narrower than the lower surface, and a 45° chamfer is formed between the upper surface and the lower surface.

16. The folder according to claim 10, wherein the plurality of mounting strips are formed of a thermoplastic material using an injection molding process.

17. The folder according to claim 10, wherein the layer of gripping material is formed of a VELCRO™ brand gripping material.

18. A method of mounting a gripping surface on the outer circumferential surface of a cutting cylinder in a printing press, comprising the steps of:

inserting a first end of a mounting strip having a layer of gripping material disposed thereon into a first slot formed on the outer circumferential surface of the cylinder, wherein the layer gripping material corrugates ribbons passing through the folding section of the printing press and imparts a certain stiffness to the ribbons so that they exit the cutting cylinder in a straight configuration; and inserting a second end of the mounting strip having a keeper tab mounted thereon into a second slot.

19. The method of mounting a gripping surface according to claim 18, wherein the step of inserting the second end of the mounting strip into the second slot includes the step of snapping the keeper tab into a "t" slot.

20. The method of mounting a gripping surface according to claim 18, further comprising the step of removing a worn gripping surface previously mounted on said cylinder before said gripping surface is mounted on said cylinder.

21. The method of mounting a gripping surface according to claim 18, further comprising the step of mounting the layer of gripping material onto the mounting strip using a self adhesive before the mounting strip is mounted on the cylinder.

22. The method of mounting a gripping surface according to claim 18, wherein the inserting steps are repeated for a plurality of mounting strips, said mounting strips being mounted along the outer circumferential surface of the cylinder.

* * * * *